United States Patent [19]

Keiji

[11] 4,397,402

[45] Aug. 9, 1983

[54] EASY OPENING CONTAINER LID

[76] Inventor: Taniuchi Keiji, 6-7, Nishi-Koujiya 2-Chome, Ota-ku, Tokyo 144, Japan

[21] Appl. No.: 253,766

[22] PCT Filed: May 9, 1979

[86] PCT No.: PCT/JP79/00116

§ 371 Date: Jan. 9, 1981

§ 102(e) Date: May 6, 1980

[87] PCT Pub. No.: WO80/02410

PCT Pub. Date: Nov. 13, 1980

[51] Int. Cl.[3] ..... B65D 17/32

[52] U.S. Cl. ..... 220/268; 220/284

[58] Field of Search ..... 220/265, 266, 268, 276, 220/284

[56] References Cited

U.S. PATENT DOCUMENTS

| | | | |
|---|---|---|---|
| 3,303,957 | 2/1967 | Walter | 220/284 |
| 3,362,570 | 1/1968 | Geiger | 220/284 |
| 4,018,178 | 4/1977 | Klein | 220/268 |

*Primary Examiner*—George T. Hall

*Attorney, Agent, or Firm*—Sughrue, Mion, Zinn, Macpeak and Seas

[57] ABSTRACT

The present invention provides an easy-opening container lid, having a tear member which is lifted and removed by a small, hard piece, such as a coin, etc. This container lid is specially constructed such that both the container lid body and tear member can be assured with respect to the safety thereof after the container lid has been opened. The container lid is provided with a pressure removing score so as to prevent accidents from occurring due to the internal pressure of the container when the container lid is opened.

4 Claims, 10 Drawing Figures

EASY OPENING CONTAINER LID

DESCRIPTION

TECHNICAL FIELD

The present invention relates to a lid of easy-opening containers used for packing soft drinks, oils, etc.

BACKGROUND ART

A conventional container used for the above-mentioned purposes has a pull-off type container lid, and almost all cans which contain soft drinks and which are widely sold on the market at present have the above-mentioned type of can lid. A small number of cans having a press-breakable can lid are also manufactured and sold. These container lids can all be opened by a simple means. In short, all kinds of container lids are opened by pulling them off or press-breaking them so as to allow them to fulfill the function thereof excellently.

However, many kinds of problems concerning these can lids have been posed by the users and other people in the society. The important ones of these problems may be itemized as follows.

(1) It is necessary that both a pull-off type can lid a press-breakable can lid be opened with a smallest possible force because a force which can be applied to a can lid by a user is limited. In fact, a can lid may not fulfill its duties if too great a force is required to open it. Furthermore, even if a can lid is opened with a great deal of force, the hand or fingers of the user may possibly be hurt and, therefore, such a kind of can lid is attended with danger. Needless to say, however, it should not occur that a can lid is readily opened under some internal or external conditions when no one intends it to be opened.

(2) It is necessary that a can lid be designed such that it does not cause any danger after it has been opened since a sharp edge of a can lid after it has been opened often hurt the user. This often occurs while and after a can containing food is opened with a can opener. Accordingly, it is a matter of course that consideration be given to the safety of a can lid for the protection of users.

Consideration must be given to the edge of an opened end of a can as well as the edge of the lid of the can, which has been pulled off from the can. In short, the best safety measure against a can lid is to furnish both a base portion thereof and a separable portion thereof which is unitarily formed with the base portion with a certain kind of safety means.

(3) It is necessary that a tear portion of a can lid is not separated from a can body after the can lid has been opened. The production of cans having such a can lid has been strongly demanded recently. In fact, a tear portion of a can lid, which is made separable from a can body is mostly thrown away and difficult to recover. A tear portion of a can lid which has been thrown away has actually caused various kinds of environmental troubles. There are childred who tread on or play with such a part of a can lid to be hurt, and domestic animals which eat such a part of a can lid mistaking it for food to die.

(4) It is necessary that a can lid is never explosively opened due to the internal pressure and that a can lid which requires consideration to be given to its internal pressure be furnished with a pressure removing means.

A can lid causes a danger not only when it has an undesirable construction thereof but also when it is opened in an undesirable manner as mentioned above.

The inventor of the present invention formerly filed a patent application (JP, A, 52-024430) covering "Tearing Can Lid and Method of Producing Same", which will be described as follows, for the purpose of providing a can lid of a high safety.

A can lid according to the above-mentioned invention consists of a structure as shown in FIG. 1 and is opened by a method as illustrated in FIG. 2.

In a can lid shown in FIG. 1, a material plate 1 has an annular, cross-sectionally U-shaped or rectangular groove 2 formed by a deep drawing, and is folded in three layers at the bottom portion 3 of the groove 2 so as to form a caulked folded portion 4. Thus, a can lid having a tear portion with a score 5 on the outer surface of the folded portion 4 is formed.

In order to open this can lid, a small hard piece 6 is inserted into the annular groove 2 and inclined to press the inner wall 7 of the groove 2. As a result, the can lid is broken along the score 5. A tear member 8 inside the annular groove 2 is then removed or partially separated from the can lid to open the same. Namely, such a can lid can be opened by utilizing the principles of the lever and fulcrum with a comparatively small force, i.e. by utilizing the small piece 6 as a lever and the upper edge 9 of the annular groove 2 as a fulcrum. Since the fingers of a person never touch the score 5 when he opens the can lid, so that this can lid can be safely opened.

The condition of a can after it has been opened will be as follows.

A tear portion 11 left on a can body 10 is pressed against the outer surface of an inner end portion 12 of the bead of that portion of the can lid which consists of a folded thin plate, and in a caulked state and thus, the safety of the tear portion 11 is extremely high.

The score 5 may not be circularly provided, or it may be interrupted at certain points, so that the tear member 8 is not separated from the can body 10 after the can lid has been opened.

The above can lid, which is advantageous in many respects, still has problems as follows.

One of the problems is that, since the tear member 8 has a sharp cut edge 13 after the can lid has been opened, a person who touches the cut edge 13 may possibly be hurt. This possibly occurs when a person carries a can while gripping the half-separated tear member 8 or when a person opens a tear member to a small extent and then pull the same with his fingers to allow the can lid to be opened satisfactorily.

Another problem is that, when such a can lid, which sufficiently stands an ordinary internal pressure, is used for a can to which a comparatively high internal pressure is applied, the tear member of the can may be opened explosively to a fully extent the moment the cutting line is locally opened with a hard piece 6. In a case where the cutting line is provided at 360°, the tear member may be blown off. Accordingly, a can lid of such a can is extremely dangerous.

DISCLOSURE OF INVENTION

The present invention has been developed for the purpose of eliminating the problems of prior art can lids while utilizing the advantages thereof as they are.

Embodiments of the present invention will be described with reference to the accompanying drawings.

An embodiment of the present invention is shown in FIGS. 3 and 4.

An easy-opening container lid according to the present invention consists of a thin plate 14. The thin plate 14 is subjected to a deep drawing to form an annular, cross-sectionally U-shaped or rectangular groove 15. The thin plate 14 is folded in three layers at a bottom portion 16 of the groove 15 to form a caulked folded portion 17. The folded portion 17 has a tear section with a cutting line 19 on the outer surface 18 of the folded portion 17.

A tear member 20 inside the annular groove 15 has a recess 22 the bottom wall of which is lower than the lower end of the inner wall 21 of the groove 15. The outer wall of the tear member 20 consists of an annular, uprightly extending flange 23 formed by folding the thin plate 14 in two layers.

This easy-opening container lid is opened as illustrated in FIGS. 5 and 6. (A container lid opening method shown in FIGS. 5 and 6 is identical with that described previously under "Background Art".)

A small piece 24 of a hard material is inserted into an annular groove 15. The small piece 24 is then inclined to press the inner wall 25 of the annular groove 15. As a result, the container lid is broken along a score 19, and a tear member 20 inside the annular groove 15 is lifted and separated. Thus, the container lid is opened.

In the above-described container lid opening operation, the principles of the lever and fulcrum are utilized. Namely, the upper edge 26 of the annular groove 15 is used as a fulcrum. Therefore, a container lid according to the present invention can be opened with a comparatively small force. Moreover, the fingers of a person never touch the score directly during a container lid opening operation. In consequence, it may be clearly understood that a container lid according to the present invention can be opened safely. The effect described above of the present invention is identical with that of a can lid described under "Background Art".

The characteristic features of the present invention actually reside in its effect obtainable after the container lid has been opened.

After an easy-opening container lid according to the present invention has been opened, a tear portion 27 left on a container lid body has a sharp edge outside a turn-up end 28 of a folded portion 17. Therefore, this container lid can be safely opened by a person just as the can lid described under "Background Art".

During this container lid opening operation, the tear member 20 is lifted and separated from the remaining part of the container lid as a tear edge 29 of the tear member 20 is joined to the annular, upright flange 23. This allows the fingers of a person to be prevented from directly touching the tear edge 29 owing to the corner 30 of the recess 22. Thus, the safety of the container lid can be assured.

When the score 19 is provided in the vicinity of the base of the inner wall 25, a sharp portion of the container lid can be substantially prevented from being exposed to a person.

An end of an easy-opening container according to the present invention thus has a high safety with respect to tear portions of a container body and a tear member. Accordingly, it can be said that a container lid described above gives a perfect solution to the problems concerning the safety of container lids of this kind.

In an end of an easy-opening container according to the present invention, it is possible that an interrupted, not continuous, score be provided. When a score is formed in this manner, a tear member will be left on the container lid body at an interrupted portion of the score even after the tear member has been lifted to open the container body, so that the separation of the tear member from the container lid body can be prevented. Since both the container lid body and a tear member are formed such as to have a high safety, the container lid be opened very conveniently.

If the score is provided in a certain manner, the container lid can be opened after the internal pressure of the container has been removed.

Another embodiment of the present invention having an interrupted score is shown in FIGS. 7–9.

An embodiment shown in FIG. 7 has an interrupted score, not a continuous one as in a previously described embodiment. The score in the embodiment shown in FIG. 7 has a discontinuous portion 32 in which a pressure removing score 33 of a suitable length is formed. This container lid is also opened with a small, hard piece as the previously described embodiment.

First of all, the container lid is broken along the pressure removing score 33. Since the length of the score 33 is small, it may be broken sufficiently in one action. The pressure removing score 33 only is opened through this action as shown in FIG. 9. The air in the container then flows out therefrom through a small opening 34 formed in the score 33 so that the internal and external pressures of the container become equal to each other. In this case, a tear member 35 is never blown off explosively because the pressure removing score 33 is not connected at its both ends to the score 31. Namely, only a small opening 34 is formed and the tearing never progresses outside of the opening 34.

Secondly, the container lid is broken along the score 31 which is provided separately from the pressure removing score 33. As a result, the container lid is opened as shown in FIG. 9. At this time, the tear member 35 is, of course, left on a container lid body 36 at the discontinuous portion 32 of the cutting line 31.

It is evident that the above concept of forming a pressure removing score is applied not only to an easy-opening container lid according to the present invention but also to the can lid referred to under "Background Art".

A container lid according to the present invention which is not yet opened is shown in FIG. 10. This container lid is opened initially at a pressure removing score 37 with the same opening means as mentioned above. It is clear that this container lid has the same effect as mentioned above.

Figure 1:
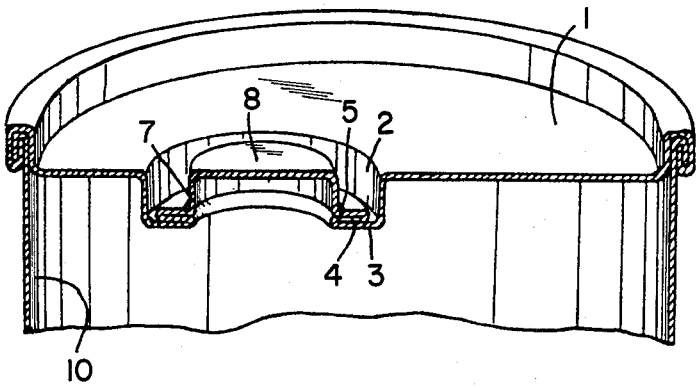
FIG. 1 is a perspective view in section of a principal portion of a conventional easy-opening container lid.
Figure 2:
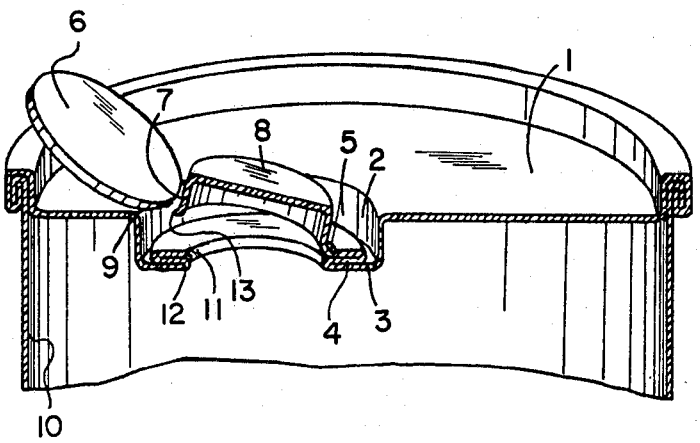
FIG. 2 is a perspective view in section of a principal portion of the container lid shown in FIG. 1, which is in an opened state.
Figure 3:
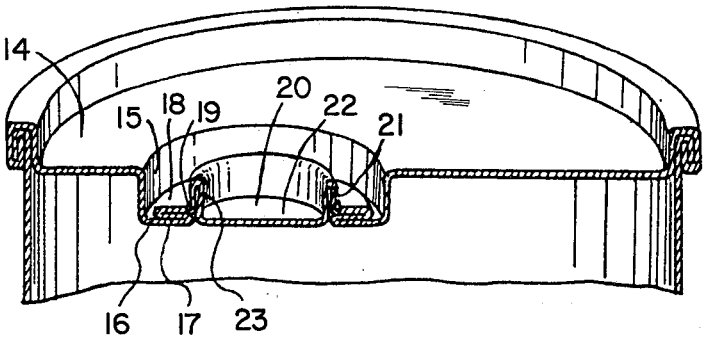
FIG. 3 is a perspective view in section of a principal portion of an easy-opening container lid embodying the present invention.
Figure 4:
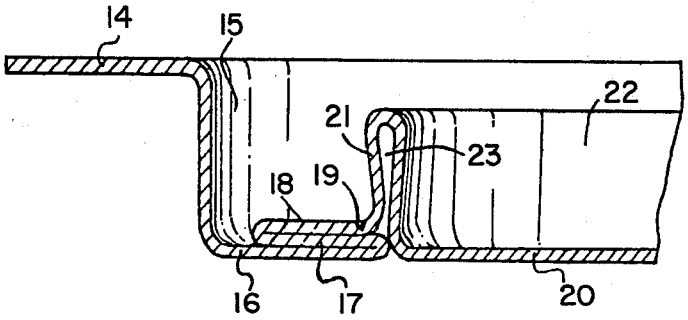
FIG. 4 is an enlarged sectional view of a principal portion of the container lid shown in FIG. 3.
Figure 5:
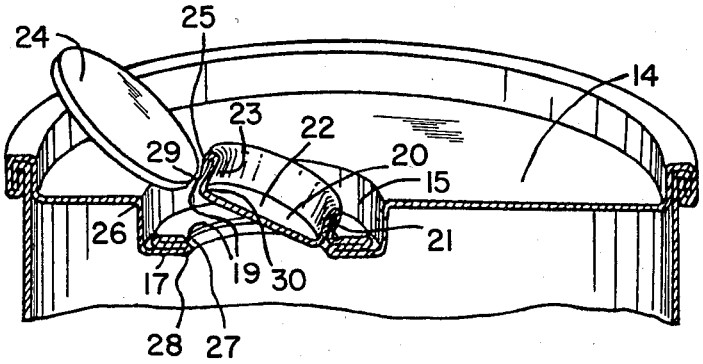
FIG. 5 is a perspective view in section of a principal portion of the container lid shown in FIG. 3, which is in an opened state.
Figure 6:
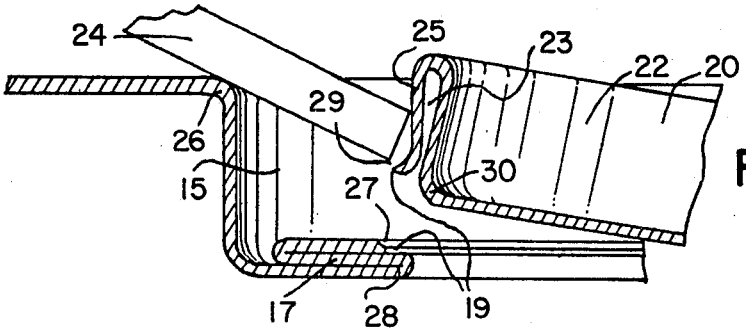
FIG. 6 is an enlarged sectional view of a principal portion of the container lid shown in FIG. 3, which is in an opened state.

Referring to the accompanying drawings, reference numeral 1 denotes a material for a container lid, 2 an annular groove, 3 a bottom portion, 4 a folded portion, 5 score, 6 a small, hard piece, 7 an inner wall, 8 a tear member, 9 a corner, 10 a container body, 11 a tear portion, 12 an end portion of a bead, 13 a tear portion the tear member, 14 a material for a container lid, 15 an annular groove, 16 a bottom portion, 17 a folded portion, 18 an outer surface, 19 a score, 20 a tear member 21 an inner wall of the annular groove, 22 a recess, 23 an annular, uprightly extending flange, 24 a small, hard piece, 25 an inner wall of the groove, 26 a corner, 27 a tear portion of a container lid body, 28 a turn-up end, 29 a tear end of the tear member, 30 a corner, 31 a score, 32 a discontinuous portion, 33 a pressure removing score, 34 a small opening, 35 a tear member, and 36 a container body.

BEST MODE FOR CARRYING OUT THE INVENTION

Figure 7:
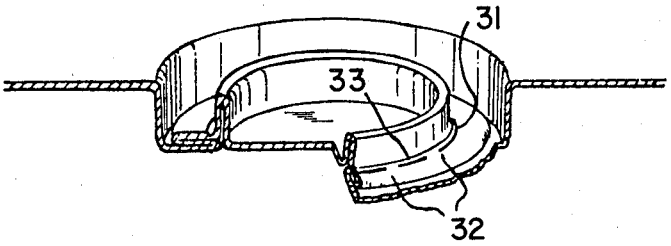
FIG. 7 is a perspective view in section of a principal portion of another embodiment of the present invention.
Figure 8:
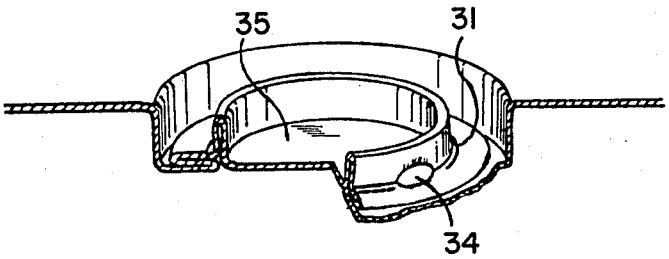
FIG. 8 is a perspective view in section of a principal portion of the embodiment shown in FIG. 7, which is in an initial stage of an opening operation therefore.
Figure 9:
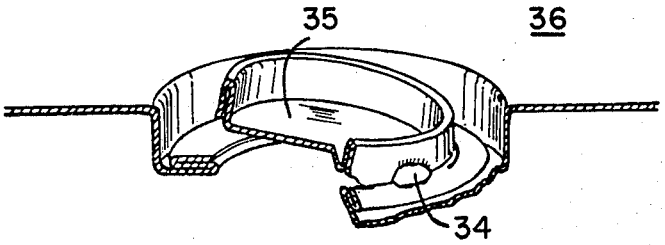
FIG. 9 is a perspective view in section of a principal portion of the embodiment shown in FIG. 7, which is in progressed stage of an opening operation therefore.
Figure 10:
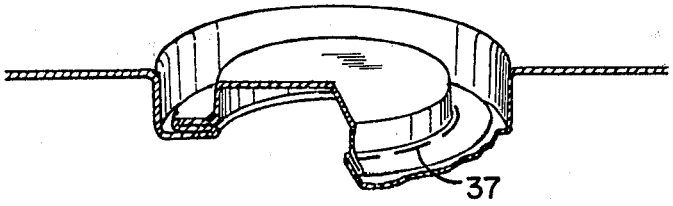
FIG. 10 is a perspective view in section of a principal portion of still another embodiment of the present invention.

The present invention can be best carried out in a mode as shown in FIG. 7. An easy-opening container lid according to the present invention is opened as shown in FIG. 9, from which the effect of the invention may be clearly noted. Namely, the safety of an easy-opening container lid according to the present invention is perfectly assured even after it has been opened. It never causes a person to be hurt who openes it since it permits the internal pressure to be removed therefrom. Moreover, it can be opened with a comparatively small force. Also, it includes a tear member which is not separated from the container lid body after the container lid has been opened. Namely, it gives a solution to the problems involved in conventional container lids of this kind.

INDUSTRIAL APPLICABILITY

The present invention is based on an optimum technical concept with respect to container lids which are widely used for containers for packing soft drinks, oils, etc. and has a high industrial applicability.

What is claimed is:

1. An easy-opening container lid, comprising a container lid body made of a thin plate and having a tear portion which consists of an annular, cross-sectionally U-shaped or rectangular groove formed by deep drawing, the bottom wall of which is folded in three layers and caulked, and which is provided with a score on the outer surface of the folded bottom wall; and a tear member having a double-layer side wall also constituting an inner wall of said annular groove, which inner wall thereby forms an annular, uprightly extending double-layer flange, and a recess in the central portion of said tear member, said container lid being characterized in that a tear end of said tear portion and a tear end of said tear member which are left on a container body after said container lid has been broken along said score by inserting a small, hard piece into said annular groove and inclining the same to press the inner wall thereof are assured with respect to the safety thereof.

2. An easy-opening container lid according to claim 1, wherein said score is provided not continuously in a circular direction but interrupted at certain points.

3. An easy-opening container lid according to claim 1, wherein said score is provided not continuously in a circular direction but interrupted at certain points; and a pressure removing score is provided in the discontinuous portion of said circular score.

4. An easy-opening container lid, comprising a container lid body made of a thin plate and having a tear portion which consists of an annular, cross-sectionally U-shaped or rectangular groove formed by deep drawing, the bottom wall of which is folded in three layers and caulked, and which is provided with a score on the outer surface of the folded bottom wall, said container lid being characterized in that said score is provided not continuously in a circular direction but interrupted at certain points with a pressure removing score provided in the discontinuous portion of said circular score.

* * * * *